US011598557B2

(12) United States Patent
Perez et al.

(10) Patent No.: US 11,598,557 B2
(45) Date of Patent: Mar. 7, 2023

(54) PRE-MIX BURNER ASSEMBLY FOR LOW NOX EMISSION FURNACE

(71) Applicant: Lennox Industries Inc., Richardson, TX (US)

(72) Inventors: Eric Perez, Hickory Creek, TX (US); Randal Poirier, The Colony, TX (US); Eric Chanthalangsy, Grand Prairie, TX (US); Steven Schneider, Plano, TX (US); Glenn W. Kowald, Carrollton, TX (US); Ian Burmania, Rockwall, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 17/505,886

(22) Filed: Oct. 20, 2021

(65) Prior Publication Data

US 2022/0049875 A1 Feb. 17, 2022

Related U.S. Application Data

(63) Continuation of application No. 15/723,284, filed on Oct. 3, 2017, now Pat. No. 11,187,433.

(51) Int. Cl.

| | |
|---|---|
| ***F24H 3/08*** | (2022.01) |
| ***F24H 9/1881*** | (2022.01) |
| ***F23D 14/02*** | (2006.01) |

(52) U.S. Cl.

CPC ..... *F24H 3/087* (2013.01); *F23D 14/02* (2013.01); *F24H 9/1881* (2013.01);
(Continued)

(58) Field of Classification Search

CPC ..... F24H 3/087; F24H 3/025; F24H 3/105; F24H 9/1881; F23D 14/02;
(Continued)

(56) References Cited

U.S. PATENT DOCUMENTS

| | | | |
|---|---|---|---|
| 4,087,234 | A | 5/1978 | Delyannis |
| 4,318,688 | A | 3/1982 | Buschulte et al. |

(Continued)

FOREIGN PATENT DOCUMENTS

| | | | |
|---|---|---|---|
| CA | 2132915 | C | 5/2000 |
| DE | 69603389 | T2 | 4/2000 |

(Continued)

OTHER PUBLICATIONS

U.S. Appl. No. 15/723,340, Perez, et al.
U.S. Appl. No. 15/723,564, Perez, et al.
U.S. Appl. No. 15/723,284, Perez, et al.

*Primary Examiner* — Vivek K Shirsat
(74) *Attorney, Agent, or Firm* — Shackelford, Bowen, McKinley & Norton, LLP

(57) ABSTRACT

A burner assembly according to aspects of the disclosure includes a burner surface carried by a burner, the burner surface extending outward from a front side of the burner, a housing coupled to the burner on a side opposite the front side of the burner, a gasket disposed between the burner and the housing, a thermally anisotropic protective covering located on the front side of the burner and surrounding a perimeter of the burner surface, and an igniter positioned adjacent to the burner surface.

18 Claims, 8 Drawing Sheets

(52) U.S. Cl.
CPC ..... *F23D 2212/00* (2013.01); *F23D 2900/00018* (2013.01); *F23D 2900/14001* (2013.01)

(58) Field of Classification Search
CPC ..... F23D 2212/00; F23D 2900/00018; F23D 2900/14001; F23D 14/14
USPC ..... 126/110 C, 116 C, 104 R, 104 A, 116 A; 431/326, 7
See application file for complete search history.

(56) References Cited

U.S. PATENT DOCUMENTS

| | | | | |
|---|---|---|---|---|
| 4,515,145 | A | 5/1985 | Tallman et al. | |
| 4,541,411 | A | 9/1985 | Woolf | |
| 4,561,421 | A | 12/1985 | Hwang et al. | |
| 4,900,245 | A * | 2/1990 | Ahmady | C04B 41/5001 431/74 |
| 5,311,930 | A | 5/1994 | Bruenn | |
| 5,893,358 | A | 4/1999 | Whitfield | |
| 6,129,628 | A | 10/2000 | O'Hagin et al. | |
| 6,238,206 | B1 | 5/2001 | Cummings, III et al. | |
| 8,616,194 | B2 | 12/2013 | Sherrow et al. | |
| 9,316,411 | B2 | 4/2016 | Sherrow et al. | |
| 9,772,119 | B2 | 9/2017 | Shellenberger et al. | |
| 10,281,143 | B2 * | 5/2019 | Batson | F23J 15/06 |
| 2004/0068970 | A1 | 4/2004 | Hasegawa et al. | |
| 2005/0048430 | A1 | 3/2005 | Steiner | |
| 2005/0076621 | A1 | 4/2005 | Chang | |
| 2008/0314378 | A1 | 12/2008 | Khan et al. | |
| 2009/0098496 | A1 | 4/2009 | Poirier | |
| 2010/0310998 | A1 | 12/2010 | Raleigh et al. | |
| 2012/0024281 | A1 * | 2/2012 | Lyons | F24C 3/082 431/126 |
| 2012/0247444 | A1 | 10/2012 | Sherrow et al. | |
| 2013/0277144 | A1 | 10/2013 | Tange et al. | |
| 2013/0302737 | A1 | 11/2013 | Schultz et al. | |
| 2014/0011143 | A1 | 1/2014 | Barozzi et al. | |
| 2014/0174426 | A1 | 6/2014 | Moon et al. | |
| 2014/0202443 | A1 | 7/2014 | Sherrow et al. | |
| 2015/0083105 | A1 | 3/2015 | Akbarimonfared et al. | |
| 2015/0184850 | A1 | 7/2015 | Seeley | |
| 2015/0192291 | A1 | 7/2015 | Akbarimonfared et al. | |
| 2015/0369495 | A1 | 12/2015 | Maricic et al. | |
| 2016/0040905 | A1 | 2/2016 | Shellenberger et al. | |
| 2016/0102888 | A1 | 4/2016 | Kuckelkorn et al. | |
| 2017/0009981 | A1 | 1/2017 | Shaw et al. | |
| 2017/0009982 | A1 | 1/2017 | Garloch et al. | |
| 2017/0241666 | A1 | 8/2017 | Kowald | |
| 2017/0241668 | A1 | 8/2017 | Kowald | |
| 2018/0080659 | A1 | 3/2018 | Brake | |
| 2018/0202652 | A1 | 7/2018 | Batson et al. | |
| 2018/0259179 | A1 | 9/2018 | Kowald et al. | |
| 2019/0101282 | A1 | 4/2019 | Perez et al. | |
| 2019/0101283 | A1 | 4/2019 | Perez et al. | |
| 2019/0101308 | A1 | 4/2019 | Perez et al. | |
| 2021/0088211 | A1 | 3/2021 | Daddis et al. | |

FOREIGN PATENT DOCUMENTS

| | | |
|---|---|---|
| EP | 1571398 A2 | 9/2005 |
| EP | 2163820 A1 | 3/2010 |

* cited by examiner

PRE-MIX BURNER ASSEMBLY FOR LOW NOX EMISSION FURNACE

CROSS REFERENCE TO RELATED APPLICATIONS

This application is a continuation of U.S. patent application Ser. No. 15/723,284, filed on Oct. 3, 2017. U.S. patent application Ser. No. 15/723,284 is incorporated herein by reference. This patent application incorporates by reference for any purpose the entire disclosure of U.S. patent application Ser. No. 15/723,340, filed on Oct. 3, 2017. This patent application incorporates by reference for any purpose the entire disclosure of U.S. patent application Ser. No. 15/723,564, filed on Oct. 3, 2017 which is now U.S. Pat. No. 10,711,997.

TECHNICAL FIELD

The present disclosure relates generally to furnaces utilized with heating, air conditioning, and ventilation ("HVAC") equipment and more specifically, but not by way of limitation, to pre-mix furnace assemblies utilizing a pre-mix burner assembly having a gasket and a protective covering to prevent damage to the pre-mix burner assembly.

BACKGROUND

This section provides background information to facilitate a better understanding of the various aspects of the disclosure. It should be understood that the statements in this section of this document are to be read in this light, and not as admissions of prior art.

Furnaces are common equipment in many commercial and residential HVAC systems. Operation of such furnaces typically includes the controlled combustion of a hydrocarbon fuel such as, for example, propane or natural gas, in the presence of atmospheric air. Theoretically, complete stoichiometric combustion of the hydrocarbon fuel yields carbon dioxide ($CO_2$), water vapor ($H_2O$), Nitrogen ($N_2$), and heat energy. In practice, however, complete stoichiometric combustion of the hydrocarbon fuel rarely occurs due to factors including, for example, combustion residence time and hydrocarbon fuel/air mixture ratio. Incomplete combustion of the hydrocarbon fuel yields combustion byproducts including, for example, carbon monoxide (CO) and various nitrous oxides (NOx). CO and NOx are generally regarded to be environmental pollutants and emissions of byproducts such as CO and NOx are commonly limited by federal, state, and local regulations. NOx, in particular, has recently been the subject of aggressive pollution-reducing agendas in many areas. As a result, manufacturers of furnaces and related HVAC equipment have undertaken efforts to reduce emission of NOx.

SUMMARY

A burner assembly according to aspects of the disclosure includes a burner surface carried by a burner, the burner surface extending outward from a front side of the burner, a housing coupled to the burner on a side opposite the front side of the burner, a gasket disposed between the burner and the housing, a thermally anisotropic protective covering located on the front side of the burner and surrounding a perimeter of the burner surface, and an igniter positioned adjacent to the burner surface.

A burner assembly according to aspects of the disclosure includes a burner surface carried by a burner plate, the burner surface extending outward from a front side of the burner surface, a housing coupled to the burner plate on a side opposite the front side of the burner plate, a gasket disposed between the burner and the housing, the gasket being formed of a single layer of material, and an igniter positioned adjacent to the burner surface.

A furnace assembly according to aspects of the disclosure includes an intake manifold fluidly coupled to a supply line, a burner assembly fluidly coupled to the intake manifold, the burner assembly having a burner surface carried by a burner, the burner surface extending outward from a front side of the burner, a housing coupled to the burner on a side opposite the front side of the burner, a gasket disposed between the burner plate and the housing, a thermally anisotropic protective covering located on the front side of the burner and surrounding a perimeter of the burner surface, wherein a thermal conductivity across a length and across a width of the thermally anisotropic protective covering is higher than a thermal conductivity across a thickness of the thermally anisotropic protective covering, an igniter positioned adjacent to the burner surface, a burner box assembly thermally exposed to the burner assembly, and a heat-exchange tube fluidly coupled to the burner box assembly.

This summary is provided to introduce a selection of concepts that are further described below in the detailed description. This summary is not intended to identify key or essential features of the claimed subject matter, nor is it to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

During operation of a furnace, production of NOx is typically dependent upon factors including, for example, hydrocarbon fuel/air mixture ratio and residence time. In general, combustion of a hydrocarbon fuel/air mixture (e.g. greater than approximately 50% excess air) is desired. Additionally, a well-mixed hydrocarbon fuel/air mixture with a low residence time is desirable for low NOx production and emission. "Residence time" refers to a probability distribution function that describes the amount of time a fluid element could spend inside a chemical reactor such as, for example, a combustion chamber.

Most residential and commercial HVAC equipment utilize induced draft "atmospheric" burners. Atmospheric burners are characterized by an initial mixing of atmospheric air and the hydrocarbon fuel. This is typically accomplished by entraining the atmospheric air into the hydrocarbon fuel stream via, for example, a venturi or other similar device. This initial entrainment of atmospheric air into the hydrocarbon fuel stream is commonly referred to as "primary air." Atmospheric burners typically operate with a rich hydrocarbon fuel to primary air mixture and thus require an additional source of air commonly referred to as "secondary air" to fully complete the combustion process, which results in a relatively large flame volume. The large flame volume increases combustion residence times, which allows further NOx production to occur. In atmospheric burners, combustion typically occurs in the presence of excess air. Excess air helps to cool off the products of combustion and spreads the combustion process over a larger area. The flame is typically drawn by a combustion air blower into a heat exchanger. This contributes to longer combustion times which results in increased production of NOx.

Another type of furnace utilizes a pre-mix burner. Pre-mix burners are typically fan powered, which allows the hydrocarbon fuel/air mixture ratio to be carefully controlled to eliminate the requirement for secondary air to complete the combustion process. Pre-mix burners operate with a lean hydrocarbon fuel/air mixture and often exhibit short blue flames. Pre-mix burners exhibit short reaction zones and high burning velocities. This leads to short residence time and high combustion efficiency, which limits NOx production and emission.

Figure 1:
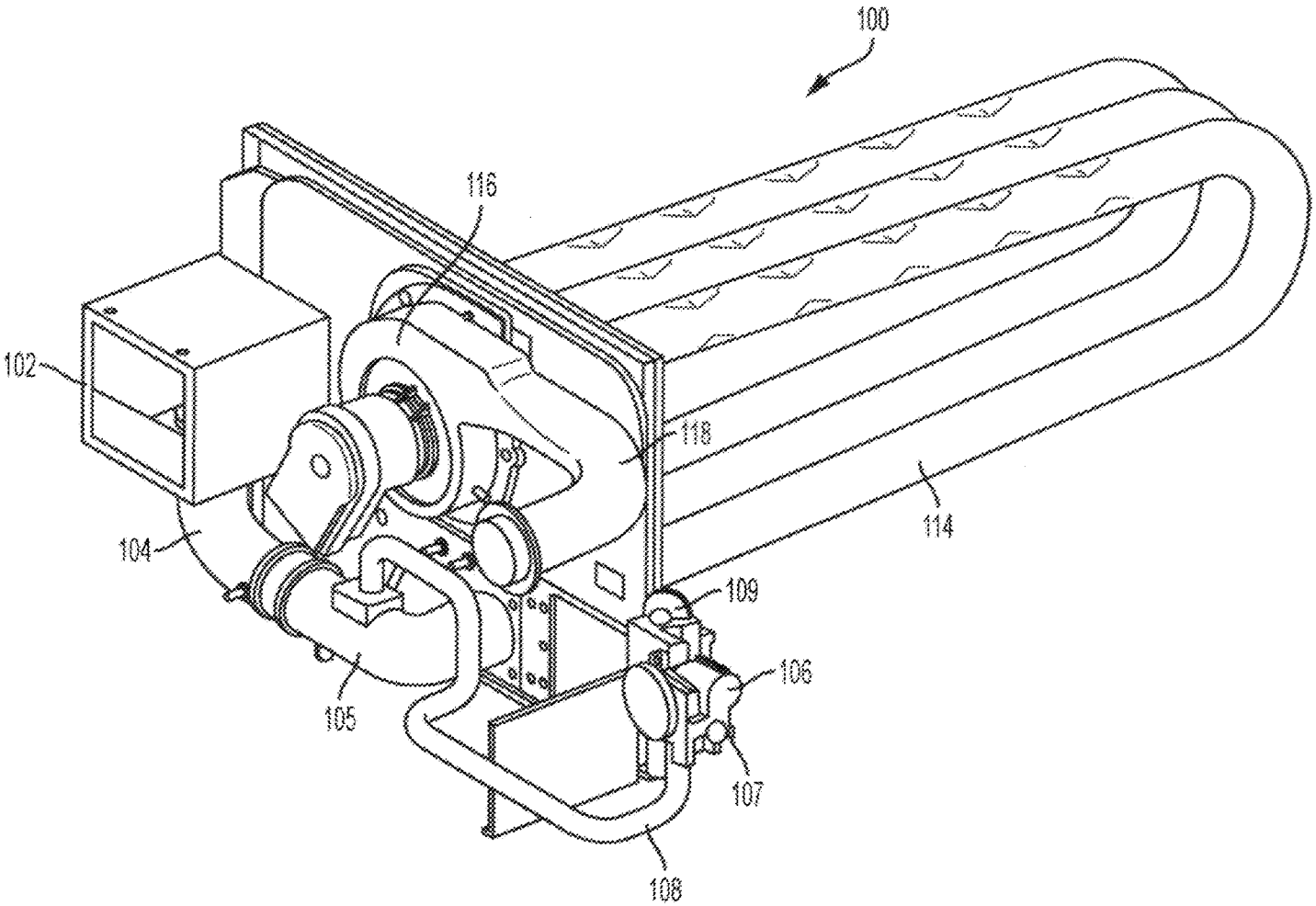
FIG. 1 is a perspective view of an illustrative furnace assembly implementing a pre-mix burner assembly in accordance with aspects of the disclosure.

FIG. 1 is a perspective view of an illustrative furnace assembly 100 implementing a pre-mix burner assembly 110 in accordance with aspects of the disclosure. The furnace assembly 100 includes a fresh-air intake 102 that is fluidly coupled to a supply line 104. The supply line 104 is fluidly coupled to an intake manifold 105. A fuel valve 106 regulates a volume of hydrocarbon fuel that is supplied to a fuel tube 108. The fuel valve 106 is, for example, an electrically-actuated solenoid valve that opens or closes responsive to an electrical current being applied to a terminal 107 of the fuel valve 106. The fuel valve 106 includes a fuel inlet 109. The fuel inlet is fluidly coupled to, for example, a supply of a hydrocarbon fuel. The fuel tube 108 supplies the hydrocarbon fuel to the intake manifold 105. In the intake manifold 105, the hydrocarbon fuel mixes with atmospheric air supplied through the fresh-air intake 102 and the supply line 104 to form a hydrocarbon fuel/air mixture. A fan 116 is fluidly coupled to an exhaust manifold 118. The fan 116 is fluidly coupled to a heat-exchange tube 114. The fan 116 is, for example a surface blower; however, in other embodiments, other types of fans could be utilized.

Figure 2:
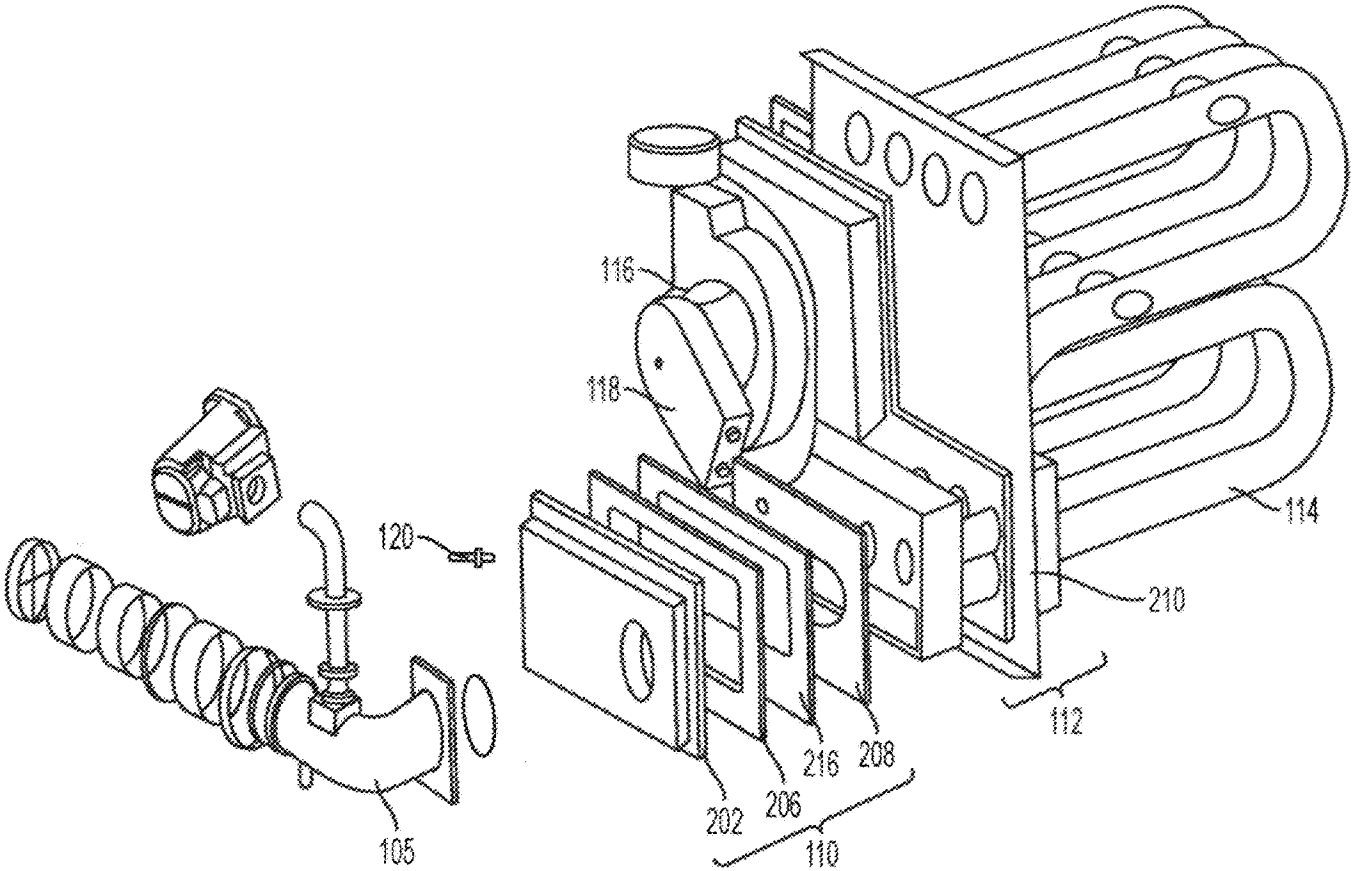
FIG. 2 is an exploded perspective view of the illustrative furnace assembly.
Figure 3:
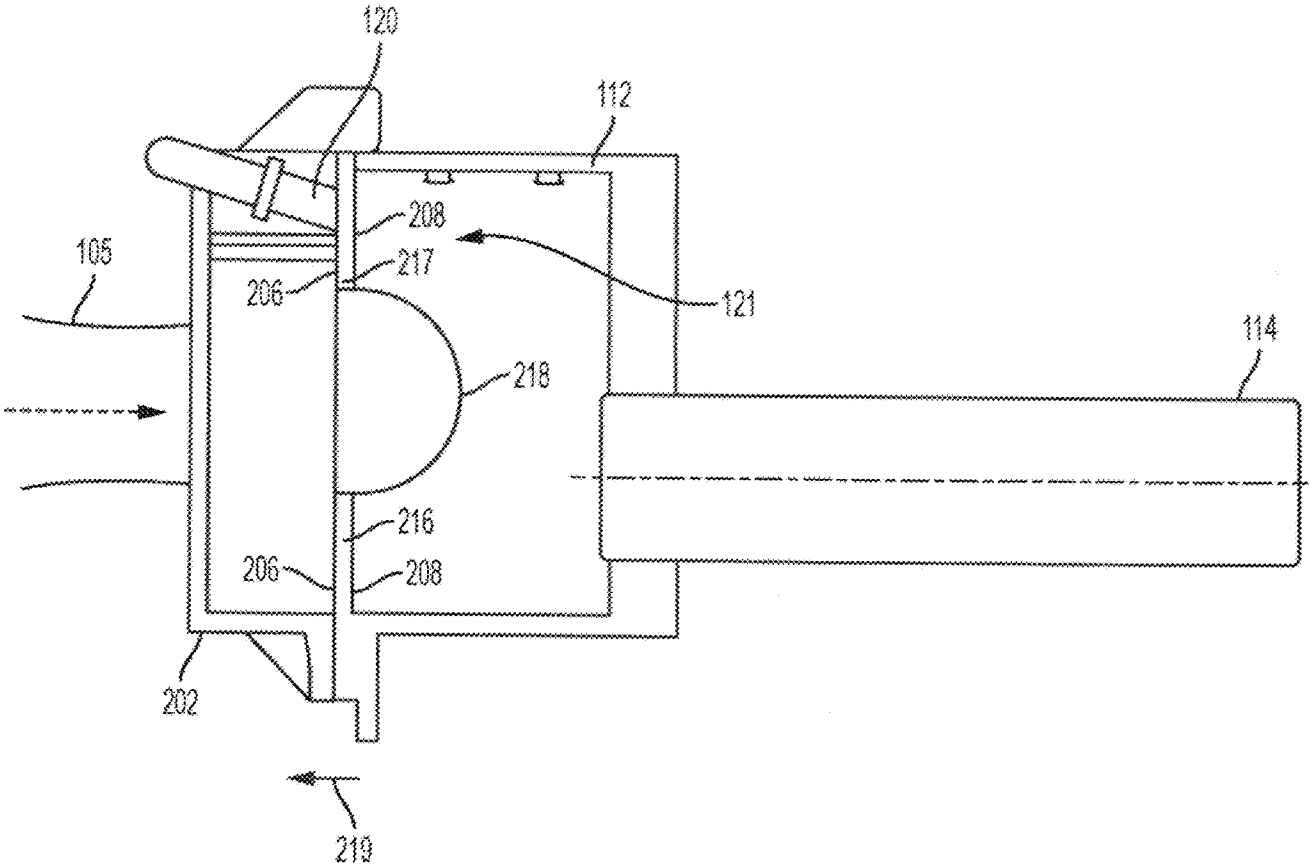
FIG. 3 is a cross sectional view of an illustrative burner assembly installed in a burner box assembly.

FIG. 2 is an exploded perspective view of the illustrative furnace assembly 100. FIG. 3 is a cross sectional view of an illustrative burner assembly 110 installed in a burner box assembly 112. Referring to FIGS. 2-3 collectively, the heat-exchange tube 114 is fluidly coupled to a burner box assembly 112 that is thermally exposed to a pre-mix burner assembly 110. The pre-mix burner assembly 110 includes a housing 202 and a burner plate 216 coupled to the housing. A burner surface 218 extends from the burner plate 216. A gasket 206 is positioned between the burner plate 216 and the housing 202. The burner plate 216 is formed of a high temperature resistant material such as, for example, 409 or 441 stainless steel. 441 stainless steel is a ferritic chromium stainless steel. The gasket 206 is formed of a single layer of material compared to multiple layers of material. A protective covering 208 abuts the burner plate 216 on a front side 217 facing the burner box assembly 112. The pre-mix burner assembly 110 is fluidly coupled to the intake manifold 105. During operation, the fan 116 draws the hydrocarbon fuel/air mixture through the intake manifold 105 and through the pre-mix burner assembly 110. During operation, the fan 116 controls the amount of combustion air. The fan 116 is also, for example, pneumatically coupled to the fuel valve 106 to maintain the mixture ratio of hydrocarbon fuel to atmospheric air to ensure that the proper amount of excess air is maintained. A low NOx premix combustion system, such as the furnace assembly 100, requires a gas-air linkage to maintain a consistent gas-air ratio. The supply line 104 includes a venturi arranged in a coupling upstream of the intake manifold 105. During operation, the venturi pressure is communicated to the fuel valve 106 through pressure tubing. The fuel valve 106 and a speed of the fan 116 are modulated according to the measured venturi pressure thereby maintaining the proper amount of excess air for combustion. In other embodiments, the pressure in the supply line 104 could be measured electronically using, for example, a pressure transducer. Maintaining the proper amount of excess air reduces production and emission of NOx. Igniters 120 extend through the housing 202, the gasket 206, the burner plate 216, and the protective covering 208 and ignite the hydrocarbon fuel/air mixture in the burner box assembly 112. The igniters 120 utilize a hot surface to ignite the hydrocarbon fuel/air mixture; however, the igniters 120 could utilize, for example, an electrical spark or a pilot flame to combust the hydrocarbon fuel/air mixture. The burner box assembly 112 is thermally exposed to the pre-mix burner assembly 110 and contains the combustion of the hydrocarbon fuel/air mixture. The fan 116 continues to draw hot combustion byproducts through the heat-exchange tube 114 and into the exhaust manifold 118. In this manner, the furnace assembly 100 exhibits short combustion residence time when compared to atmospheric burners, which contributes to low NOx production and emission. From the exhaust manifold 118, the combustion byproducts are exhausted to the exterior environment.

Still referring to FIGS. 2-3, the gasket 206 is positioned between the housing 202 and the burner plate 216. The gasket 206 is constructed of a material such as, for example, graphite, that is heat-resistant and thermally anisotropic. Construction from an anisotropic material allows the gasket 206 to function as a temperature spreader or heat sink in addition to functioning as a heat shield. The gasket 206, thus, reduces temperature differences between adjacent regions and reduces localized stress resulting from uneven thermal expansion and repeated on/off cycling. The term "anisotropic" refers to a property that the gasket 206 exhibits higher thermal conductivity in the plane defined by the length and width of the gasket 206 and lower thermal conductivity across the thickness of the gasket 206. In an embodiment, the gasket 206 has a thickness of approximately 0.080". When assembled, the gasket 206 is compressed between the housing 202 and the burner box 112. The gasket 206 prevents escape of combustion heat and byproducts from the burner box assembly 112. In use, the gasket 206 improves accessibility of the pre-mix burner assembly 110 for purposes of, for example, maintenance, over burner designs utilizing several layered gaskets. The gasket 206 allows the burner plate 216 to flex due to, for example, thermal expansion while still containing combustion byproducts within the burner box assembly 112. During operation, the gasket 206 reduces combustion temperatures inside the burner box assembly 112 by reducing an amount of heat that reflects back through the burner plate 216. The material properties of the gasket 206 facilitate sealing against air leaks and facilitate thermal expansion. In other embodiments, additional thermal barriers can be disposed between the gasket 206 and the housing 202.

Figure 4:
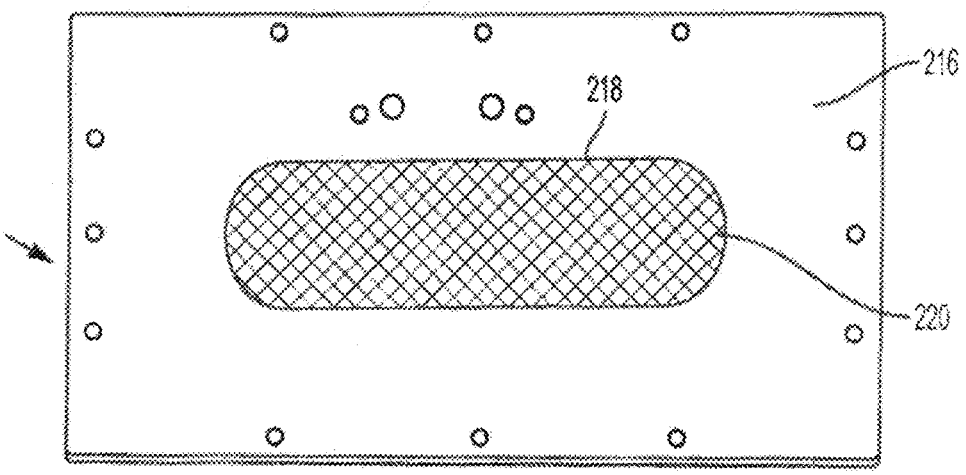
FIG. 4 is a front view of an illustrative burner with the protective covering removed.
Figure 5:
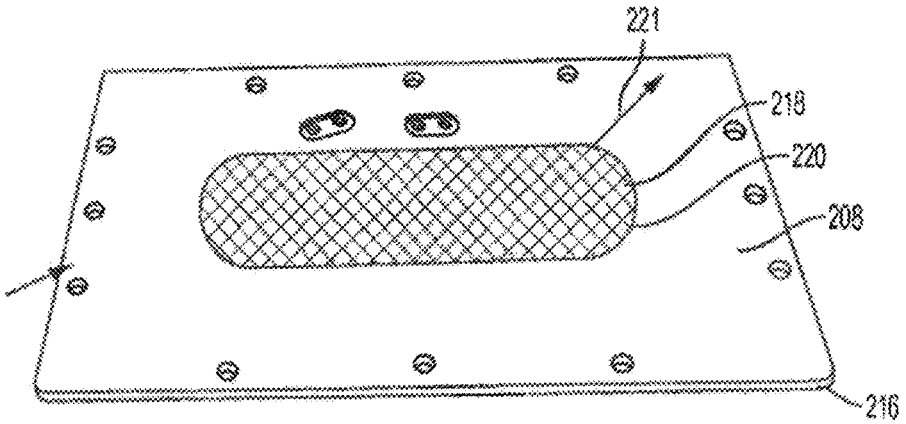
FIG. 5 is a front view of the illustrative burner showing a protective covering.

FIG. 4 is a front view of the burner plate 216 with the protective covering 208 removed in accordance with one or more aspects of the disclosure. FIG. 5 is a front view of the burner plate 216 showing the protective covering 208 in accordance with one or more aspects of the disclosure. For purposes of illustration, FIGS. 4-5 are discussed herein relative to FIGS. 1-3. The burner plate 216 has a burner aperture 220 defined therein. The burner aperture 220 allows flow of the hydrocarbon fuel/air mixture from the intake manifold 105 into the burner surface 218. The burner surface 218 is disposed across the burner aperture 220 and protrudes outwardly from the burner plate 216. When assembled, a distal end 121 of the igniters 120 is disposed proximate the burner surface 218 so as to facilitate combustion of the hydrocarbon fuel/air mixture at the burner surface 218. During operation, combustion of the hydrocarbon fuel/air mixture occurs at the burner surface 218. The protective covering 208 is disposed on the burner plate 216 and around a perimeter of the burner surface 218 on a front side 217 facing the burner box assembly 112. The protective covering 208 is constructed of a material such as, for example, graphite, that is heat-resistant and thermally anisotropic. Thus, the protective covering 208 exhibits higher thermal conductivity in the plane defined by the length and width of the protective covering 208 and lower thermal conductivity across the thickness of the protective covering 208. In various embodiments, the protective covering 208 is fastened to the burner plate 216 via fastening members such as, for example, screws or other threaded fasteners. In other embodiments, the protective covering 208 is a coating that is applied to the burner plate 216 via an application process such as, for example, spraying. During operation, the protective covering 208 insulates the burner plate 216 and prevents damage to the burner plate 216 resulting from, for example, high combustion temperatures. Additionally, the anisotropic properties of the protective covering 208 cause heat to be conducted radially away from the burner surface 218 evenly across a length and width of the burner plate 216 thereby preventing formation of hot spots on a surface of the burner plate 216. An exemplary direction of heat conduction by the protective covering 208 is illustrated by arrow 221 in FIG. 5. The protective covering 208 also insulates against the conduction of heat through a thickness 219 (shown in FIG. 3) of the protective covering 208 thereby protecting the burner plate 216 from heat generated by combustion of the hydrocarbon fuel/air mixture. Such insulation of the burner plate 216 by the protective covering 208 prevents the formation of large temperature differentials on the burner plate 216. Prevention of temperature differentials reduces cyclical thermal stress on the burner plate 216 and extends a service life of the burner plate 216.

Figure 6:
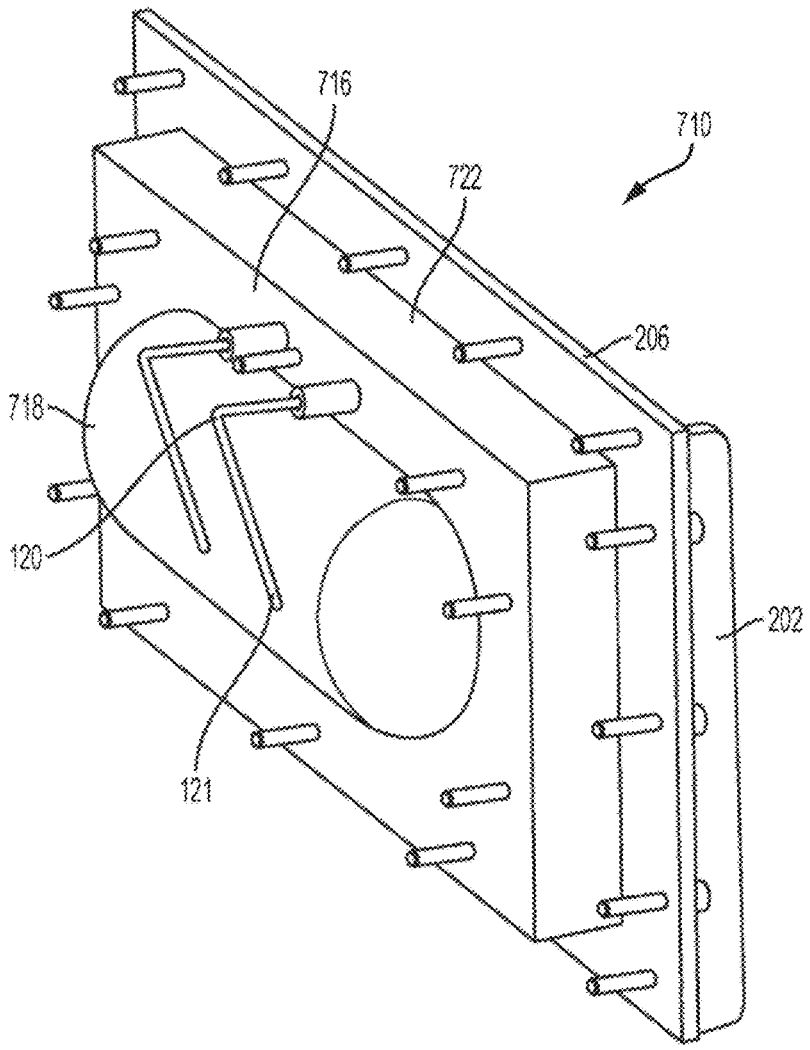
FIG. 6 is a schematic diagram of an illustrative flanged pre-mix burner assembly with a protective covering removed.
Figure 7:
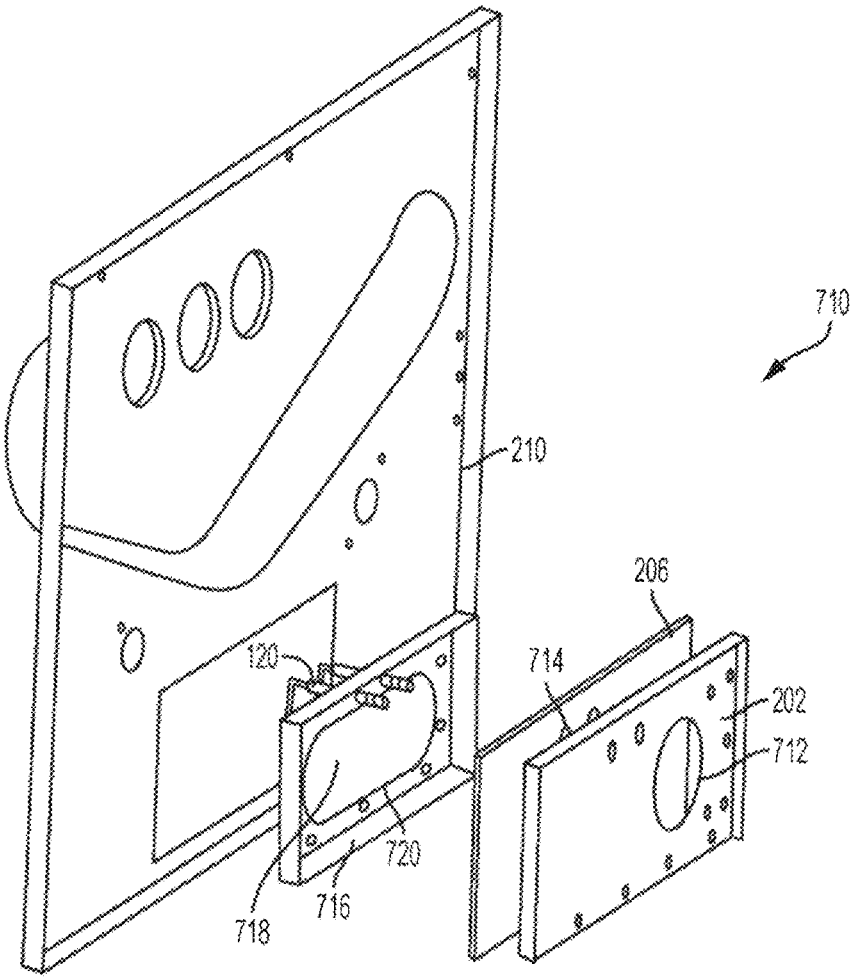
FIG. 7 is an exploded view of the illustrative flanged pre-mix burner assembly with the protective covering removed.

FIG. 6 is a schematic diagram of the flanged pre-mix burner assembly 710 with the protective covering 208 removed in accordance with one or more aspects of the disclosure. FIG. 7 is an exploded view of the flanged pre-mix burner assembly 710 with the protective covering 208 removed in accordance with one or more aspects of the disclosure. Referring to FIGS. 6-7 collectively, the flanged pre-mix burner assembly 710 includes a burner 716 which is carried by the housing 202. The gasket 206 is positioned between the housing 202 and the burner 716. The gasket 206 is constructed of a material such as, for example, graphite, that is heat-resistant and thermally anisotropic. Construction from an anisotropic material allows the gasket 206 to function as a temperature spreader or heat sink in addition to functioning as a heat shield. The gasket 206, thus, reduces temperature differences between adjacent regions and reduces localized stress resulting from uneven thermal expansion. The term "anisotropic" refers to a property that the gasket 206 exhibits higher thermal conductivity in the plane defined by the length and width of the gasket 206 and lower thermal conductivity across the thickness of the gasket 206. In an embodiment, the gasket 206 has a thickness of approximately 0.080". When assembled, the gasket 206 is compressed between the housing 202 and the burner box 112. The gasket 206 prevents escape of combustion heat and byproducts from the burner box assembly 112. In use, the gasket 206 improves accessibility of the flanged pre-mix burner assembly 710 for purposes of, for example, maintenance, over burner designs utilizing several layered gaskets. The gasket 206 allows the burner 716 to flex due to, for example, thermal expansion while still containing combustion byproducts within the burner box assembly 112.

Referring to FIGS. 6-7, a fuel aperture 712 is formed in the gasket 206 and the housing 202. When assembled, the fuel aperture 712 is fluidly coupled to the intake manifold 105 and facilitates delivery of hydrocarbon fuel/air mixture to the flanged pre-mix burner assembly 710. An igniter aperture 714 is formed through the housing 202, the gasket 206, and the burner 716. When assembled, the igniter aperture 714 facilitates placement of the igniters 120. During operation, the gasket 206 reduces combustion temperatures inside the burner box assembly 112 by reducing an amount of heat that reflects back through the burner 716. The material properties of the gasket 206 facilitate sealing against air leaks and facilitate thermal expansion. In other embodiments, additional thermal barriers can be disposed between the gasket 206 and the housing 202.

Still referring to FIGS. 6-7, the burner 716 has a burner aperture 720 defined therein. The burner aperture 720 allows flow of the hydrocarbon fuel/air mixture from the intake manifold 105 into the burner surface 718. The burner surface 718 is disposed across the burner aperture 720 and protrudes outwardly from the burner 716. When assembled, a distal end 121 of the igniters 120 is disposed proximate the burner surface 718 so as to facilitate combustion of the hydrocarbon fuel/air mixture at the burner surface 718. During operation, combustion of the hydrocarbon fuel/air mixture occurs at the burner surface 718. In various embodiments, the burner 716 includes flanges 722. The flanges are formed around a periphery of the burner 716 and are bent rearwardly away from the burner surface 718. The flanges 722 increase the strength and rigidity of the burner 716. The flanges 722 also create separation between the burner surface 718 and the housing 202. The separation facilitates even distribution of the hydrocarbon fuel/air mixture entering through the fuel aperture 712.

Figure 8:
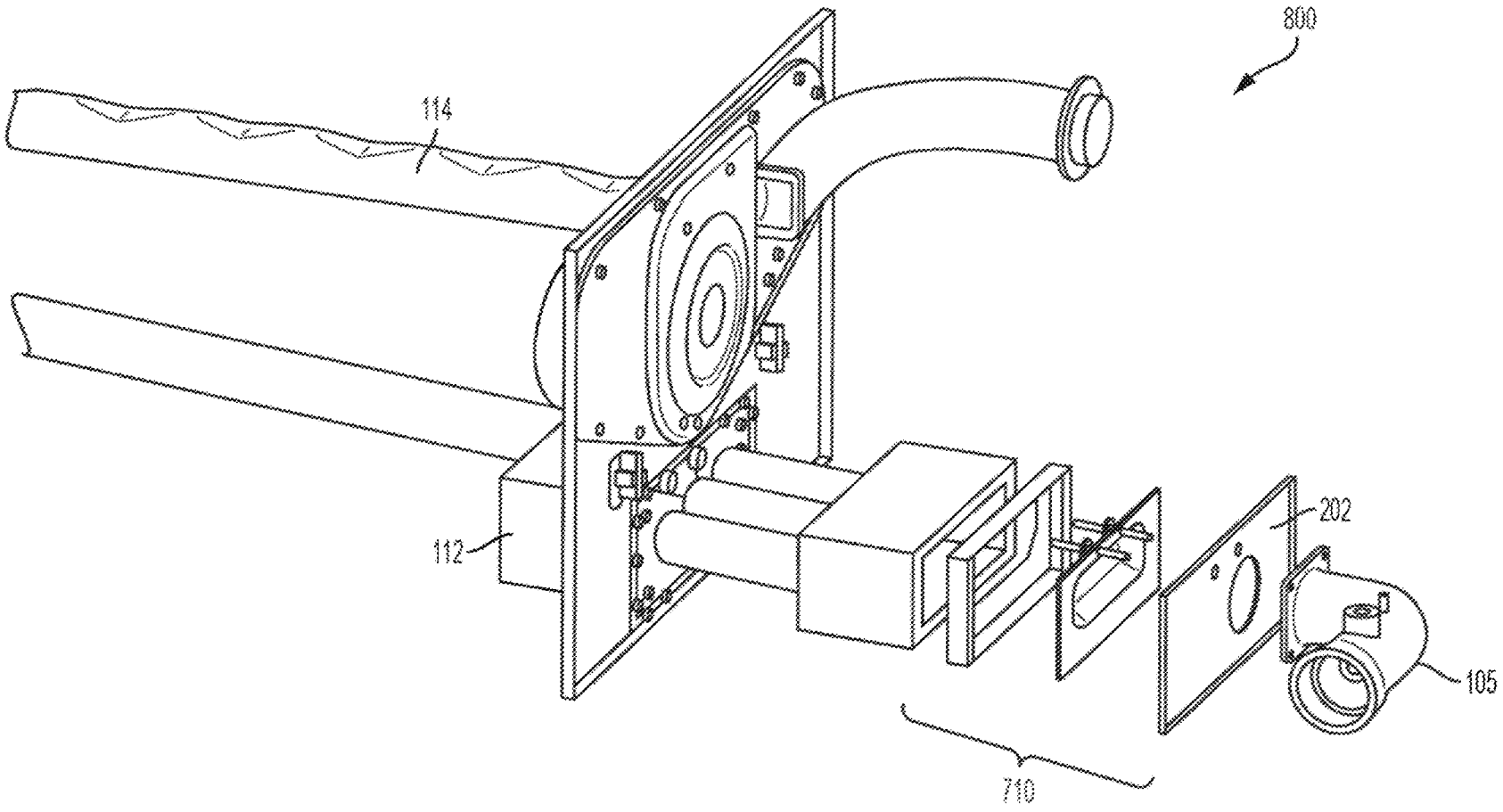
FIG. 8 is a perspective view of an illustrative furnace assembly utilizing the illustrative flanged pre-mix burner assembly in accordance with aspects of the disclosure.

FIG. 8 is a perspective view of an illustrative furnace assembly 800 utilizing a flanged pre-mix burner assembly 710 in accordance with aspects of the disclosure. When assembled, the flanged pre-mix burner assembly 710 is received into the burner box assembly 112. The burner 716 is not directly connected to the burner box assembly 112 and floats within the burner box assembly 112. Thus, during use, the burner 716 is allowed to expand, contract, and flex due to thermal expansion.

Figure 9:
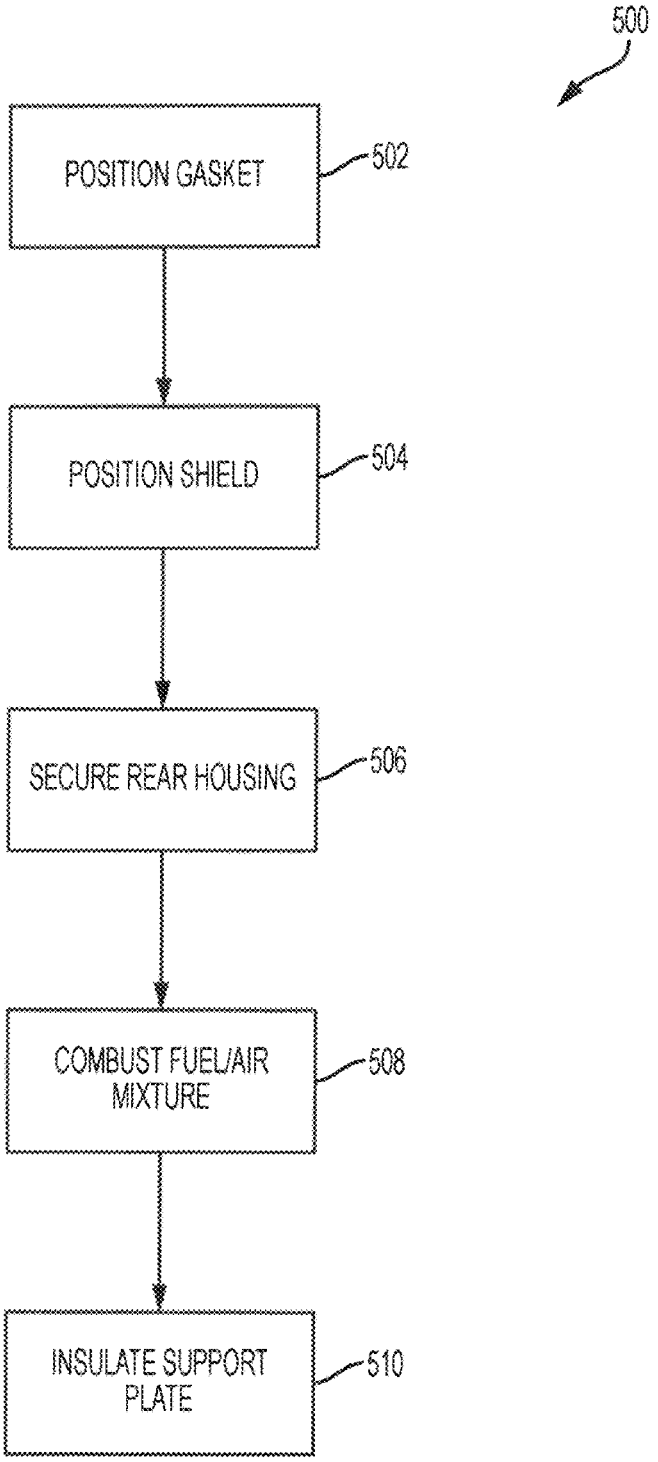
FIG. 9 is a flow diagram of an illustrative process for forming the pre-mix burner assembly.

FIG. 9 is a flow diagram of an illustrative process 500 for forming a pre-mix burner assembly in accordance with one or more aspects of the disclosure. At block 502, the gasket 206 is positioned between the burner plate 216 and the housing 202. At block 504, the protective covering 208 is positioned on the front side 217 of the burner plate 216. At block 506, the housing 202 is secured to the barrier 210 thereby compressing the gasket 206. At block 508, the hydrocarbon fuel/air mixture is combusted at the burner surface 218. At block 510, the protective covering 208 insulates the burner plate 216 from the heat of combustion and spreads the heat of combustion evenly across the burner plate 216.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined by the language of the claims that follow. The term "comprising" within the claims is intended to mean "including at least" such that the recited list of elements in a claim are an open group. The terms "a," "an," and other singular terms are intended to include the plural forms thereof unless specifically excluded.

What is claimed is:

1. A burner assembly comprising:
- a burner plate comprising a burner aperture;
- a burner surface carried by the burner plate and disposed across and extending through the burner aperture and protruding outward from the burner plate;
- a housing coupled to the burner plate;
- a gasket disposed between the burner plate and the housing, wherein a first side of the gasket is directly coupled to the burner plate and a second side of the gasket opposite the first side is coupled to the housing;
- a thermally anisotropic protective covering directly coupled to a front side of the burner plate; and
- an igniter positioned adjacent to the burner surface.

2. The burner assembly of claim 1, wherein the thermally anisotropic protective covering surrounds a perimeter of the burner surface.

3. The burner assembly of claim 2, wherein the thermally anisotropic protective covering is formed of a graphite material.

4. The burner assembly of claim 1, wherein the gasket is formed of a single layer of material.

5. The burner assembly of claim 2, wherein a thermal conductivity across a length and across a width of the thermally anisotropic protective covering is higher than a thermal conductivity across a thickness of the thermally anisotropic protective covering.

6. The burner assembly of claim 1, wherein the burner plate comprises flanges formed around a periphery of the burner plate and are bent rearwardly away from the burner surface.

7. The burner assembly of claim 6, wherein the flanges increase strength and rigidity of the burner plate.

8. The burner assembly of claim 7, wherein the flanges create separation between the burner surface and the housing facilitating even distribution of fuel/air mixture entering through a fuel aperture.

9. A furnace assembly comprising:
- an intake manifold fluidly coupled to a supply line;
- a pre-mix burner assembly fluidly coupled to the intake manifold, the pre-mix burner assembly comprising:
  - a burner plate comprising a burner aperture;
  - a burner surface carried by the burner plate and disposed across and extending through the burner aperture and protruding outward from the burner plate;
  - a housing coupled to the burner plate;
  - a gasket disposed between the burner plate and the housing, wherein a first side of the gasket is directly coupled to the burner plate and a second side of the gasket opposite the first side is coupled to the housing;
  - an igniter positioned adjacent to the burner surface; and
  - a thermally anisotropic protective covering directly coupled to a front side of the burner plate.

10. The furnace assembly of claim 9 comprising:
- a burner box assembly thermally exposed to the pre-mix burner assembly; and
- a heat-exchange tube fluidly coupled to the burner box assembly.

11. The furnace assembly of claim 9, wherein the thermally anisotropic protective covering surrounds a perimeter of the burner surface.

12. The furnace assembly of claim 11, wherein the thermally anisotropic protective covering is formed of a graphite material.

13. The furnace assembly of claim 9, wherein the gasket is formed of a single layer of material.

14. The furnace assembly of claim 11, wherein a thermal conductivity across a length and across a width of the thermally anisotropic protective covering is higher than a thermal conductivity across a thickness of the thermally anisotropic protective covering.

15. The furnace assembly of claim 9, wherein the burner plate comprises flanges formed around a periphery of the burner plate and are bent rearwardly away from the burner surface.

16. The furnace assembly of claim 15, wherein the flanges increase strength and rigidity of the burner plate.

17. The furnace assembly of claim 15, wherein the flanges create separation between the burner surface and the housing facilitating even distribution of fuel/air mixture entering through a fuel aperture.

18. A furnace assembly comprising:

an intake manifold fluidly coupled to a supply line;

a pre-mix burner assembly fluidly coupled to the intake manifold, the pre-mix burner assembly comprising:

a burner plate comprising a burner aperture;

a burner surface carried by the burner plate and disposed across and extending through the burner aperture and protruding outward from the burner plate;

a housing coupled to the burner plate;

a gasket disposed between the burner plate and the housing, wherein a first side of the gasket is directly coupled to the burner plate and a second side of the gasket opposite the first side is coupled to the housing;

an igniter positioned adjacent to the burner surface; and a thermally anisotropic protective covering directly coupled to a front side of the burner plate and surrounding a perimeter of the burner surface.

* * * * *